US009241230B2

(12) United States Patent
Horbach et al.

(10) Patent No.: US 9,241,230 B2
(45) Date of Patent: Jan. 19, 2016

(54) EXTRACTION OF CHANNELS FROM MULTICHANNEL SIGNALS UTILIZING STIMULUS

(71) Applicant: Harman International Industries, Incorporated, Northridge, CA (US)

(72) Inventors: Ulrich Horbach, Canyon Country, CA (US); Kirk Bushen, Tewksbury, MA (US); Adam Strauss, Los Angeles, CA (US); Andy Wehmeyer, Pasadena, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 332 days.

(21) Appl. No.: 13/909,458

(22) Filed: Jun. 4, 2013

(65) Prior Publication Data

US 2014/0016783 A1 Jan. 16, 2014

Related U.S. Application Data

(63) Continuation of application No. 12/858,791, filed on Aug. 18, 2010, now abandoned, which is a continuation-in-part of application No. 12/293,062, filed as application No. PCT/US2007/064006 on Mar. 14, 2007, now Pat. No. 8,121,312.

(60) Provisional application No. 60/782,369, filed on Mar. 14, 2006.

(51) Int. Cl.
*H04S 1/00* (2006.01)
*H04S 7/00* (2006.01)

(52) U.S. Cl.
CPC . *H04S 1/00* (2013.01); *H04S 7/301* (2013.01); *H04S 2420/01* (2013.01)

(58) Field of Classification Search
CPC ..... H04S 1/00; H04S 7/301
USPC ..... 381/58, 59
See application file for complete search history.

(56) References Cited

U.S. PATENT DOCUMENTS 4,888,811 A 12/1989 Takashi
5,805,715 A 9/1998 Rhee (Continued)

FOREIGN PATENT DOCUMENTS

EP 0556867 A 8/1993
EP 1017167 A 7/2000

(Continued)

OTHER PUBLICATIONS

Non-final Office Action dated Mar. 2, 2012 in U.S. Appl. No. 12/858,791, filed Aug. 18, 2010, pp. 1-17.

(Continued)

*Primary Examiner* — Sonia Gay
(74) *Attorney, Agent, or Firm* — Brooks Kushman P.C.

(57) ABSTRACT

An approach and device for optimizing a sound system by extracting a two-channel stereo source out of a set of multiple channels with unknown frequency responses, crosstalk, time delays and sample rate by employing a digital test sequence that utilizes maximum-length-sequences (MLS) that is fed into the sound system and results in a reconstructed stereo source that may be further used as an input to a signal processor that performs improved speaker and room equalization.

20 Claims, 11 Drawing Sheets

(56) References Cited

U.S. PATENT DOCUMENTS

| | | | | |
|---|---|---|---|---|
| 6,655,212 | B2 | 12/2003 | Ohta | |
| 7,158,643 | B2 * | 1/2007 | Lavoie et al. | 381/58 |
| 7,167,515 | B2 | 1/2007 | Kelly et al. | |
| 7,920,707 | B2 | 4/2011 | Tsutsui | |
| 8,090,120 | B2 | 1/2012 | Seefeldt | |
| 2004/0016336 | A1 | 1/2004 | Hagiwara | |
| 2004/0016338 | A1 | 1/2004 | Dobies | |
| 2005/0265560 | A1 * | 12/2005 | Haulick et al. | 381/58 |
| 2006/0142999 | A1 | 6/2006 | Takada et al. | |
| 2006/0241797 | A1 | 10/2006 | Craig et al. | |
| 2006/0262940 | A1 * | 11/2006 | Asada | 381/58 |
| 2007/0025559 | A1 * | 2/2007 | Mihelich et al. | 381/59 |
| 2007/0291959 | A1 * | 12/2007 | Seefeldt | 381/104 |
| 2008/0118078 | A1 | 5/2008 | Asada et al. | |
| 2009/0316930 | A1 | 12/2009 | Horbach et al. | |
| 2010/0302033 | A1 | 12/2010 | Devenyi et al. | |

FOREIGN PATENT DOCUMENTS

| | | | |
|---|---|---|---|
| EP | 0898364 | A | 2/2007 |
| GB | 2221595 | A | 2/1990 |
| WO | 03096743 | A | 11/2003 |
| WO | 03107719 | A | 12/2003 |
| WO | 2007016527 | A | 2/2007 |
| WO | 2007076863 | A1 | 7/2007 |
| WO | 2007106872 | A3 | 9/2007 |

OTHER PUBLICATIONS

Non-final Office Action dated Jul. 6, 2012 in U.S. Appl. No. 12/858,791, filed Aug. 18, 2010, pp. 1-21.

Final Office Action dated Dec. 4, 2012 in U.S. Appl. No. 12/858,791, filed Aug. 18, 2010, pp. 1-20.

Extended European Search Report for European Application No. 11177977.3 dated Jun. 25, 2014.

* cited by examiner

EXTRACTION OF CHANNELS FROM MULTICHANNEL SIGNALS UTILIZING STIMULUS

RELATED APPLICATIONS

This application is a continuation in part of and claims the priority of U.S. patent application Ser. No. 12/293,062, filed on Mar. 5, 2009, titled WIDE-BAND EQUALIZATION SYSTEM, U.S. Publication Number 2009/0316930, which is a §371 application of PCT Patent Application Serial Number PCT/US2007/064006, titled WIDE BAND EQUALIZATION IN SYSTEM, filed Mar. 14, 2007, claiming priority to U.S. Provisional Patent Application Ser. No. 60/782,369, titled WIDE BAND EQUALIZATION IN SMALL SPACES, filed Mar. 14, 2006, all the application of which are incorporated in their entirety by reference in this application.

BACKGROUND

1. Field of the Invention

The present invention relates to optimization of a multichannel sound system, and more particularly, to optimization of the performance of a multichannel sound system based upon input signals and multichannel response data.

2. Related Art

Typically, factory-installed vehicle sound systems are not amenable to aftermarket upgrades. Typically the sound systems have audio and video integrated components that are specifically designed with housings to fit specific models of a vehicle. The signal processing of these sound systems are also typically closed systems that make the modifying or reprogramming of them impractical or impossible.

The signal processing in these types of sound systems is implemented for appropriate or predetermined sound system performance, which often includes crossover and equalization filters that may be contained or tightly integrated in a head unit or an amplifier of an existing sound system that typically cannot be replaced or modified. Only final loudspeaker feeds for tweeters, midrange speakers and woofers are commonly accessible for sound system owners who desire to upgrade their sound systems with external aftermarket audio equipment. The filters implemented in the factory signal processor are normally not user-adjustable, so no method of changing or improving their performance or making adjustments appropriate for new speakers or amplifiers is available.

Prior attempts to partially solve this problem have been put forth, such as an approach to automatically generate gain coefficients for a graphic equalizer. This approach is not desirable because it requires manual user interaction that involves trial and error, i.e. finding and summing up channels with sufficient audio bandwidth, dynamic range and appropriate output signal topology, without introducing excessive stereo crosstalk. In addition, it is common that available outputs of head units or factory-installed amplifiers or signal processors are delayed differently. Also, a simple sum as used in this approach creates frequency nulls that cannot be equalized.

Accordingly, there is a need for optimizing the performance of a sound system when only inputs and outputs of the audio system are accessible. In particular, it is desirable to compensate for crosstalk, band limitations, and sample rate deviations when optimizing performance of the audio system when the crossover and equalization filters of existing sound system or head unit are unknown.

SUMMARY

In view of the above, a computing device and approach is provided that enables a periodic test sequence to be input into an existing sound system and captures the resulting output for processing and optimization. The output is typically N-channels of audio data and upon processing the audio data, sound system parameters are used to reconstruct the stereo sources for improved speaker and room equalization with run-time signal processing.

It is to be understood that the features mentioned above and those yet to be explained below may be used not only in the respective combinations indicated, but also in other combinations or in isolation without departing from the scope of the invention.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The description below may be better understood by referring to the following figures. The components in the figures are not necessarily to scale, and emphasis is instead being placed upon illustrating the principles of the invention. In the figures, like reference numerals designate corresponding parts throughout the different views.

DETAILED DESCRIPTION

Figure 1:
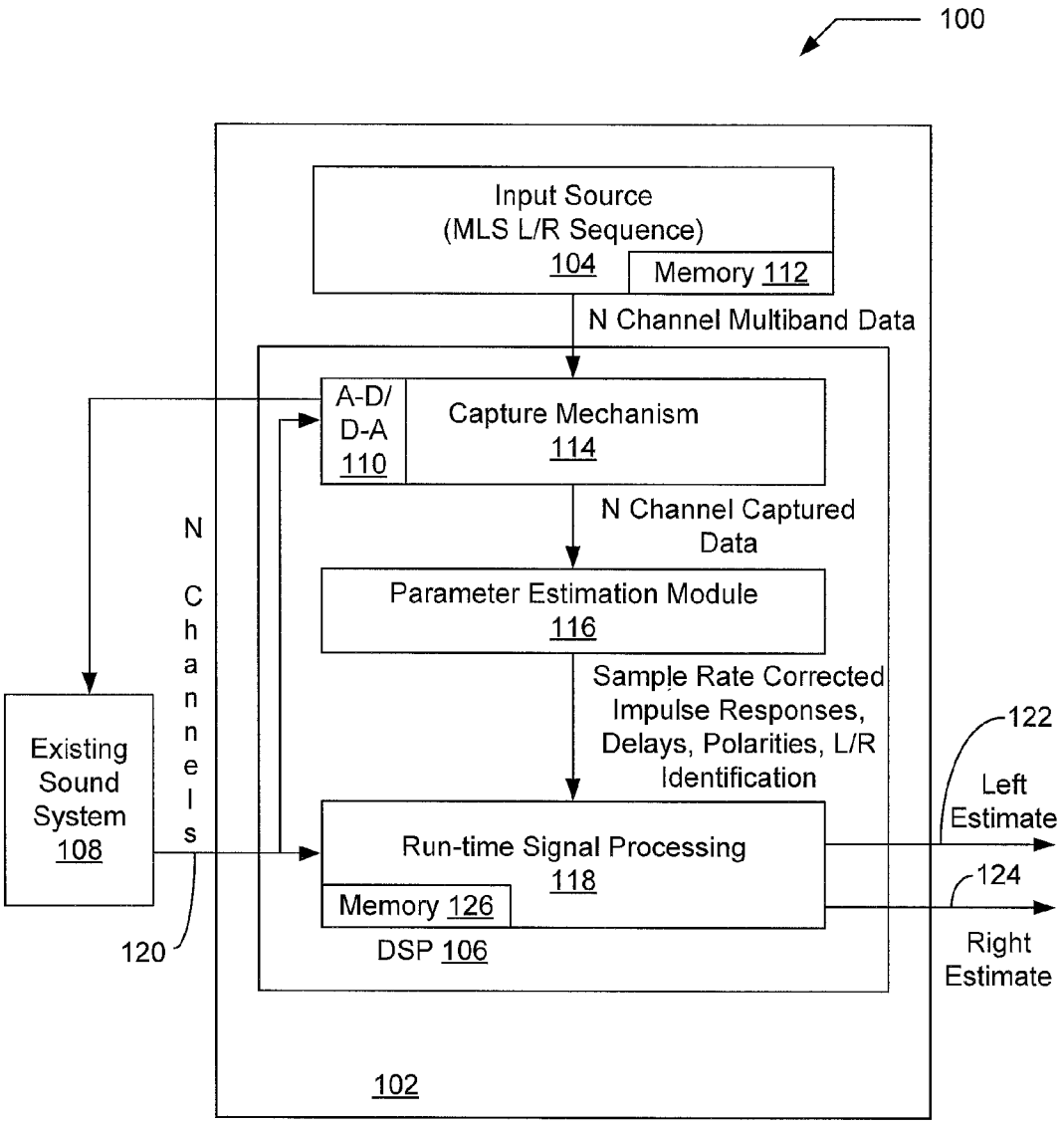
FIG. 1 is a schematic diagram of a sound system with an auxiliary device having an input source and a digital signal processor in accordance with an example of an implementation of the invention.

It is to be understood that the following description of examples of implementations are given only for the purpose of illustration and are not to be taken in a limiting sense. The partitioning of examples in function blocks, modules or units shown in the drawings is not to be construed as indicating that these function blocks, modules or units are necessarily implemented as physically separate units. Functional blocks, modules or units shown or described may be implemented as separate units, circuits, chips, functions, modules, or circuit elements. One or more functional blocks or units may also be implemented in a common circuit, chip, circuit element or unit.

In FIG. 1, a diagram of a sound system 100, with an auxiliary device 102 having an input source 104 and a digital signal processor (DSP) 106 in accordance with an example of an implementation of the invention is shown. The sound system 100 may be made up of an existing sound system 108 and an auxiliary device 102. Examples of auxiliary devices include new (non-original equipment manufactured (OEM)) speakers, amplifiers, and sound processors. Examples of an existing sound system that may have a head unit, and/or amplifier are: OEM stereo systems that are installed in various types of vehicles, aftermarket stereo equipment of unknown specifications, and audio/video system that may be OEM or after market in origin.

A periodic test sequence (typically a two-channel stereo test sequence signal) may be generated or read from a memory 112. The test sequence may then be sent or transferred from the "input source" 104 into the unknown factory head unit or amplifier of the existing sound system 108. The signal from the input source may be connected to the existing sound system 108 by a two-channel output of the auxiliary device 102 to a two channel input of the unknown factory amplifier or head unit, in which case the test sequence (first input signal and second input signal) will be played or otherwise generated from memory 112 through a digital-to-analog converter 110. The test sequence from the input source may also be input into the existing sound system 108 via a MP3 player input port (but not in a compressed format), CD player or flash/USB memory port (if the test sequence is on a compact disk (CD) or saved in flash memory). The test sequence may be saved or stored on a CD or in flash memory making the input source 104 optional in some implementations. The auxiliary device 102 may contain a digital signal processor (DSP) 106 or other logic with a capture mechanism 114, a parameter estimation module 116, and a run-time signal processing block 118.

The existing sound system 108 or unknown head unit may output N channels of audio data 120 (typically N=2 . . . 8), as a response to the stereo test sequence. This audio data may be any kind of band limited and delayed audio signal, such as tweeter, midrange driver, woofer signal, or full range signal. It is further possible that the left and right channels of the input signal may both contribute to one output channel (crosstalk).

The auxiliary device 102 may have a capture mechanism 114 that automatically detects the beginning of incoming audio data by comparing its energy with a noise threshold, and stores a sufficient amount of audio data, typically the length of several periods of the test sequence, into internal memory, resulting in N channels of captured data. The storage period will be longer than the maximum expected delay difference between any of the N channels of captured data (i.e. first output data and second output data), plus at least two periods of the test sequence itself.

The N channels of captured data may be further processed in the parameter estimation module or unit 116 that generates the parameters that are required to process the N-channels of audio data 120 during run-time, in order to generate the desired output signals ("Left Estimate" 122 and "Right Estimate" 124) in run-time signal processing block 118. Capturing and parameter estimation may both be performed only once during setup of the sound system 100. The resulting parameters such as sample rate corrected impulse responses, delays, polarities and left/right identification flags may be permanently stored in memory 126, once determined A single memory may be employed with areas defined within the single memory for memory 112 and memory 126. In other implementations, the capturing and parameter estimations may be performed at predetermined times, such as every 12 months, upon cycling the power a preset number of times (1000 cycles).

Figure 2:
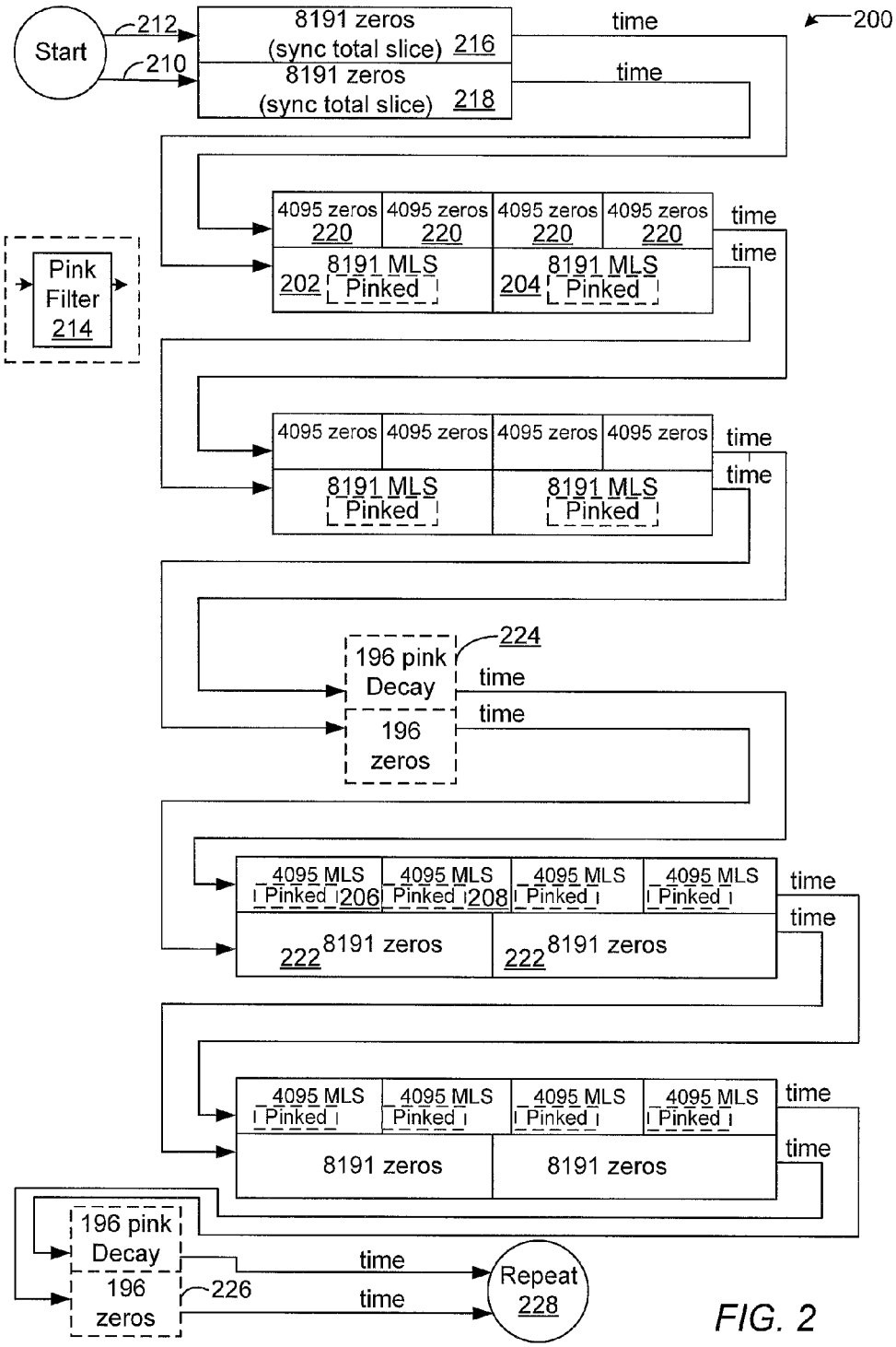
FIG. 2 is a test sequence input into the right and left input channels of the sound system of FIG. 1.

Turning to FIG. 2, a diagram 200 of the test sequence input into the right and left input channels 210 and 212 of sound system 100 of FIG. 1 is shown. Two pseudo-random maximum-length-sequences (MLS) of different lengths (L−1) 202, 204 and (L/2−1) 206, 208 may be employed in the right 210 and left 212 channels, respectively as the test sequence. The sequences that make up the test sequence may have been further pre-filtered through a "pink" filter 214 to reduce their high frequency spectral content and therefore help avoid overloading the existing sound system 108. The block length "L" may be a power of two, typically L=8191. Two different block lengths may be chosen, as one mechanism that allows identifying left and right channels 210 and 212 in the parameter estimation module 116, FIG. 1 by cross-correlation.

The test sequence may start with a block of zeros in both channels 216 and 218, and then four (in general at least two or more) blocks of MLS sequences of length (L−1) in the right channel 210, while the left channel 212 is filled with zeros 220. Then, after allowing the pink filter response to decay (if a pink filter 214 is employed) by waiting a short amount of time (for example 196 samples) 224, a block of eight (double the number than in the right channel) MLS sequences 206 and 208 of length (L/2−1) follows in the left channel 212, while now the right channel 210 is filled with zeros 222. After another short stage to decay 226 the left-channel pink filter (if a pink filtering is employed), the whole process is repeated periodically 228. Periodic repetition sequences is necessary, because the trigger point for the data analysis is unknown a priori, and may be anywhere in the middle of a sequence. In particular, a channel may be delayed with respect to another channel by more than the length of a sequence. Further, in some implementations it may be desirable to resample the entire MLS sequence based on the ratio of a known sample rate of the playback system to the sample rate of the capture system.

Figure 3:
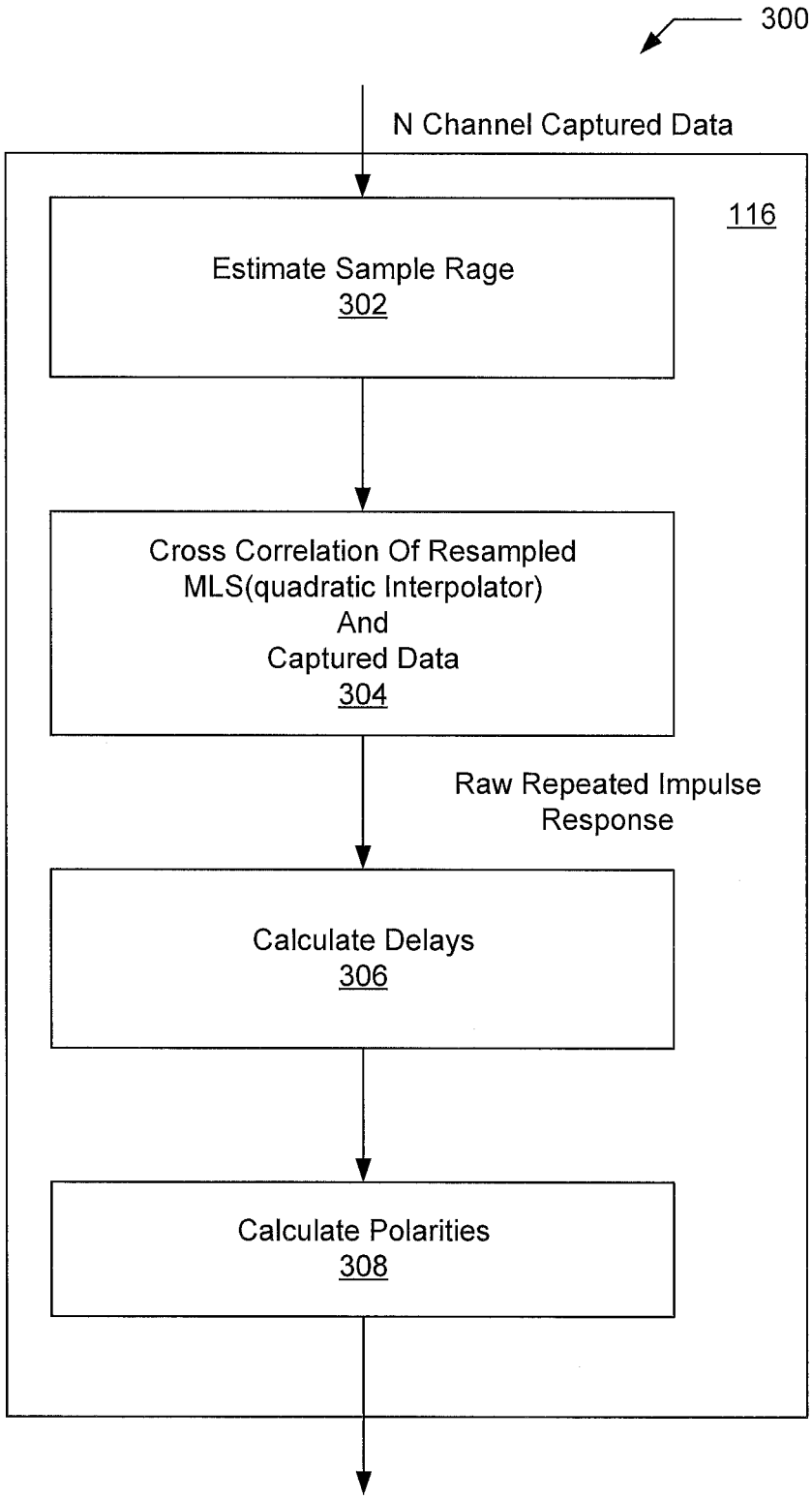
FIG. 3 is a diagram illustrating the parameter estimation steps performed by the auxiliary device of FIG. 1 in response to the test sequence of FIG. 2.

In FIG. 3, a diagram 300 illustrating the parameter estimation steps performed by the parameter estimation module 116 of the auxiliary device 102 of FIG. 1 in response to the test sequence 200 of FIG. 2 is depicted. The four steps of the parameter estimation module 116 follow after the data capture of the N-channel capture data. Since the sample rates of the existing sound system 108 or head unit and DSP processor 106 may differ slightly, a possibility of introducing unacceptable errors may occur. Further, a sample rate estimator 302 may precede the actual parameter estimator or be part of the parameter estimation module 116.

The MLS sequence may then be converted to a newly estimated rate by applying quadratic interpolation in the spectral domain. A cross-correlation module 304 that cross-correlates between MLS and captured data generates impulse response sequences of the existing sound system 108, FIG. 1. Final steps are estimation of delays in the delay estimation module 306 and determining the polarities in the polarities module 308 in all captured channels, and assignment of each of the input channels to the left channel 422, right channel 424, mono 426, or none as shown in FIG. 4.

Figure 4:
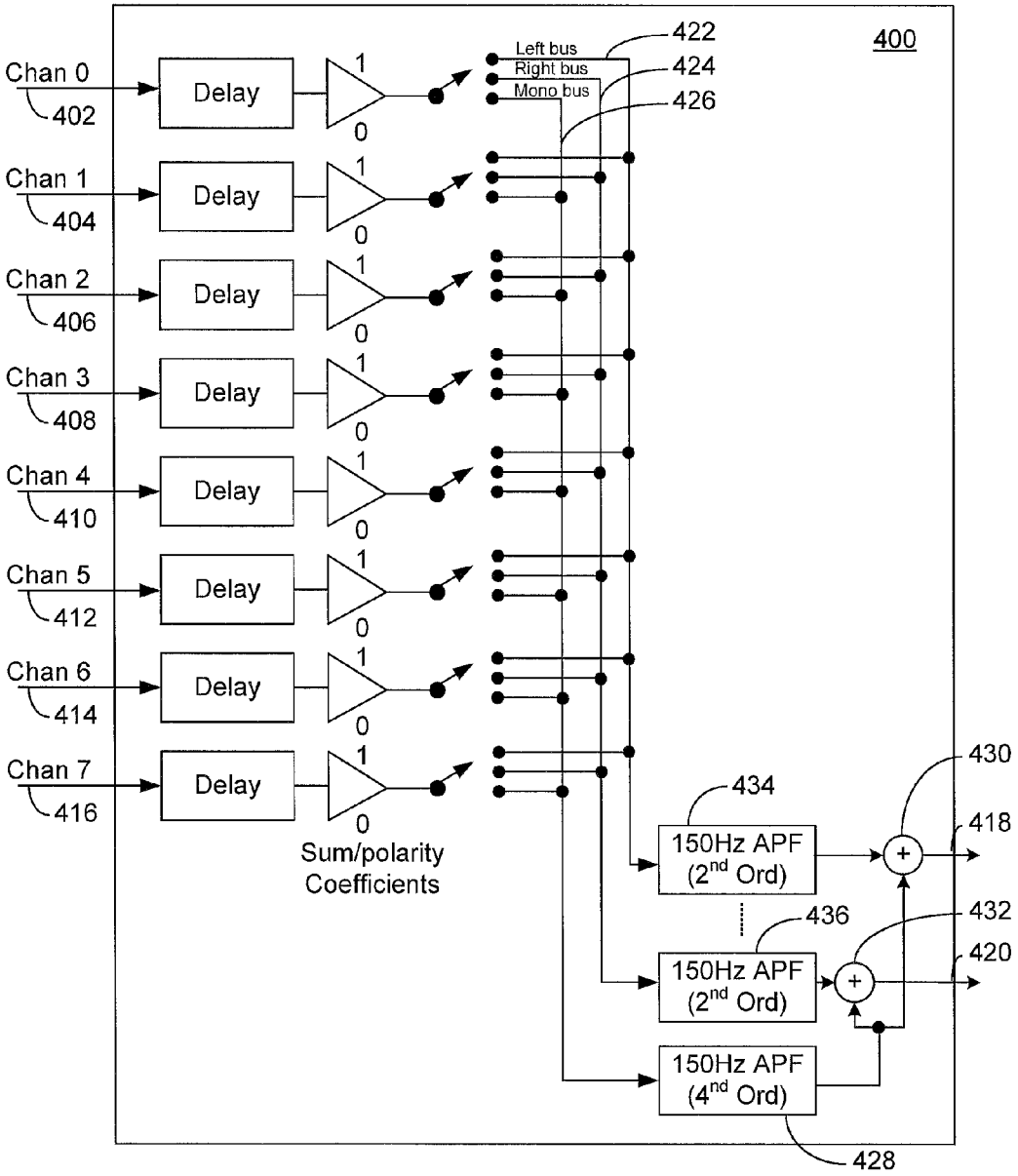
FIG. 4 is a diagram of the run time signal processing path of the auxiliary device of FIG. 1.

Turning to FIG. 4, a diagram 400 of the run time signal processing path of the auxiliary device of FIG. 1. In this example, eight channels 402-416 coming from the existing sound system or head unit are depicted being processed, while two extracted channels are generated at its output 418 and 420. The two channels 418 and 420 are suitable for further processing in a module that performs speaker and room equalization.

The first stage conducts delay compensation, utilizing the estimated delay values from the delay estimation module 306, FIG. 3 in the parameter estimation module 116, so that all channels 402-416 are time-aligned. Then, their polarities are corrected accordingly with the polarities determined by the polarities module 308, FIG. 3. Each channel may now be assigned to the left 422, right 424, or mono 426 channel, and added to a signal bus. If a particular input channel is not detected, the channel is deemed as none and it is unassigned. The assignment flags have been determined by the parameter estimation module 116 as well, and stored in memory. The mono output is then low-pass filtered by low-pass filter 428 at 150 Hz (in general within a user-adjustable range of 50 . . . 300 Hz), and added to both outputs by combiners 430 and 432. A pair of allpass filters (APF) 434 and 436 compensates for the phase shift that the lowpass filter 428 introduces, so that no frequency nulls occur at the summing point. The mono channel may only be used to transport low-frequency content, suitable to feed one or more subwoofers.

Figure 5:
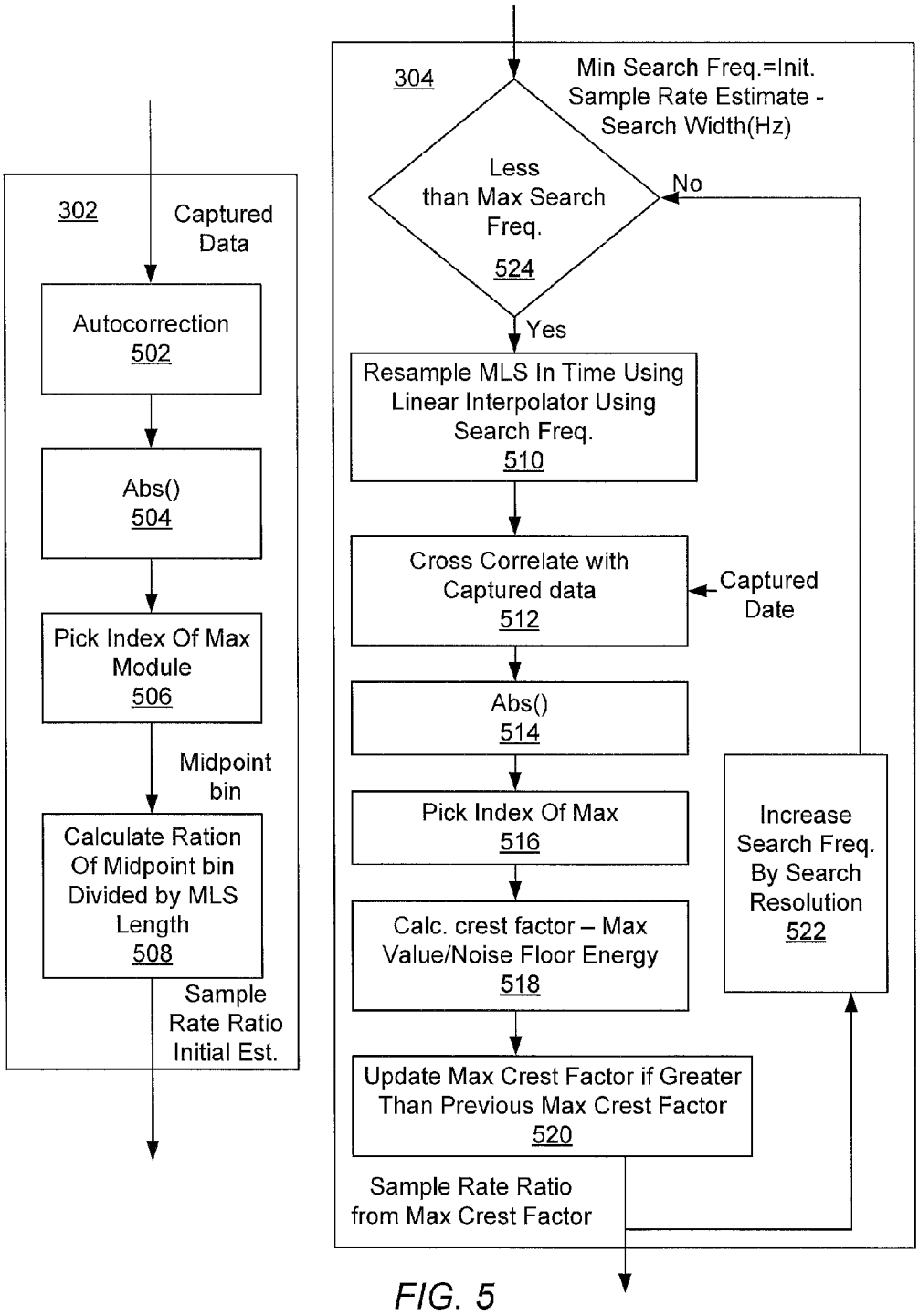
FIG. 5 is a diagram of the sample rate estimation and cross correlation modules of FIG. 3.
Figure 6:
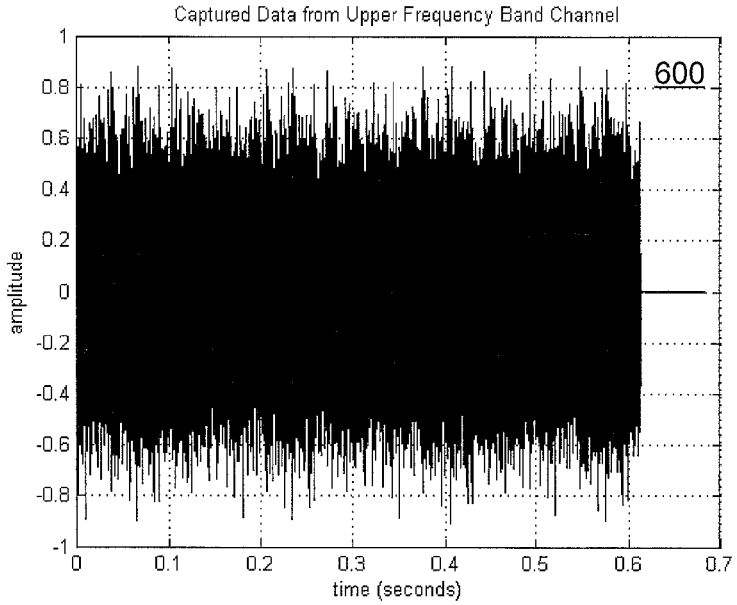
FIG. 6 is a graph of an example of the incoming response to the test sequence of FIG. 2.
Figure 7:
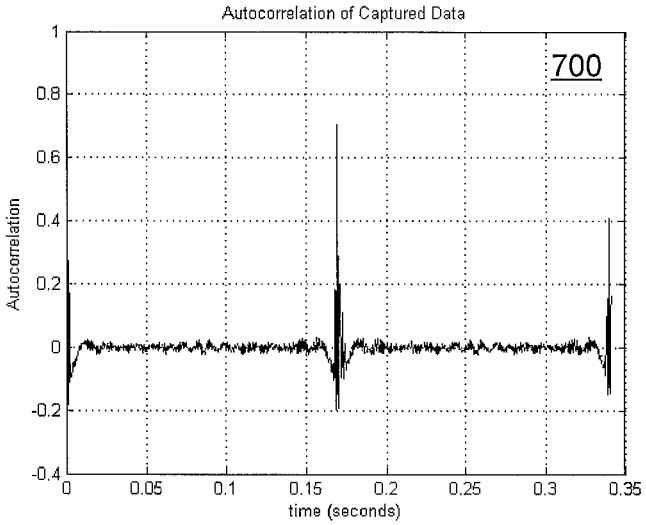
FIG. 7 is a graph of an autocorrelation sequence of the response to the test sequence of FIG. 2.

In FIG. 5, a diagram of the sample rate estimator 302 and cross-correlation module 304 of FIG. 3 is depicted. An example of the incoming response to the test sequence in one of the channels is shown in 600 FIG. 6. First the autocorrelation sequence of the signal shown in FIG. 6 is calculated by the autocorrelation module 502, resulting in a plot as shown in 700 FIG. 7. The repetition rate of the periodic peaks in that autocorrelation sequence is first measured. That rate may deviate from the MLS length "L" (for example L=8191 or L=4095). The ratio of both numbers may be employed as an initial estimate for the sample rate ratio between the unknown head unit and the DSP 106. To determine the repetition rate, the absolute value of the sequence is determined with the absolute value function 504, the sequence is then aligned so that the first maximum is at time zero, and the index of the next maximum (midpoint bin) is determined 506. The sample rate ratio may then be determined by calculation of the ratio of the midpoint bin divided by the MLS length "L" 508.

Figure 8:
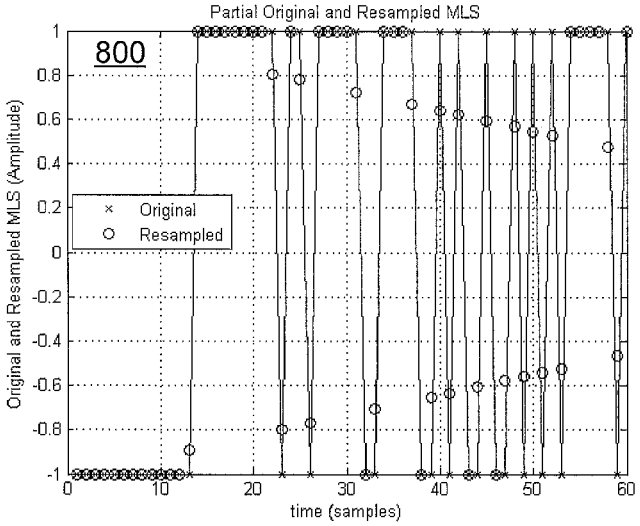
FIG. 8 is a graph of the re-sampling of the response to the test sequence of FIG. 2 using linear interpolation in the time domain.
Figure 9:
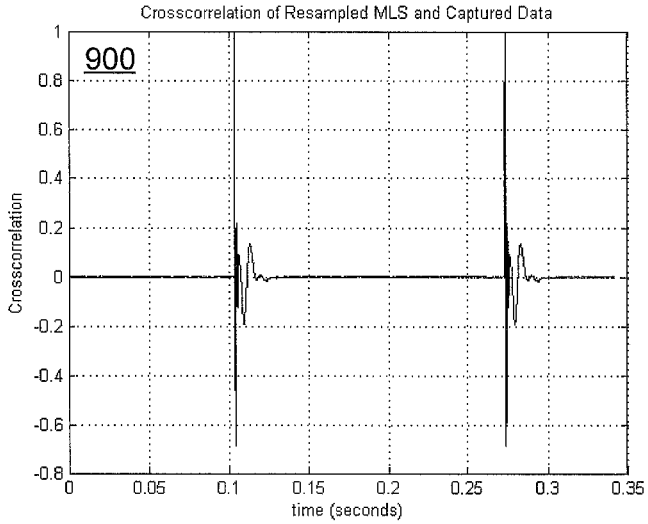
FIG. 9 is a cross-correlation sequence of the re-sampled test sequence of FIG. 8 with the response to the test sequence of FIG. 2.

The cross-correlation search approach improves the accuracy of the initial sample rate estimate. The search is conducted in discrete steps spanning a small interval around the initial estimate, typically +/−0.006%, with a frequency step size of typically 0.001%. In each step, the MLS sequence is re-sampled 510 by using linear interpolation in the time domain as shown in 800 FIG. 8, then the cross-correlation 512 with the captured data is computed with the results shown in 900 FIG. 9. An absolute value function 514 may then be applied to the cross-correlated data.

Figure 10:
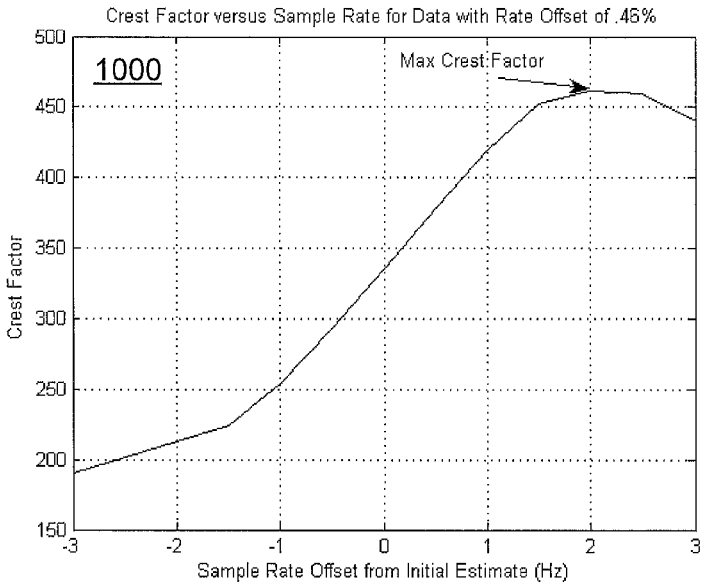
FIG. 10 is a graph of the crest factor versus sample rate for determination of the sample rate of the sound system of FIG. 1.

In module 516 the index of the maximum of the sequence is identified. The maximum is then used to calculate the crest factor 518. The more accurately the sample rates match, the higher the absolute value of the maximum of the sequence will be, compared with the noise floor. The ratio of both values, the crest factor, may then be used to determine the optimum match 520, which gives an improved estimate for the sample rate as shown in 1000 FIG. 10, where FIG. 10 is a graph of the crest factor versus sample rate offset, for determination of the sample rate of the sound system of FIG. 1. The search frequency may be increased by an amount corresponding to a desired search resolution 522, and another iteration loop performed if the actual search frequency is less than the maximum search frequency 524.

Figure 11:
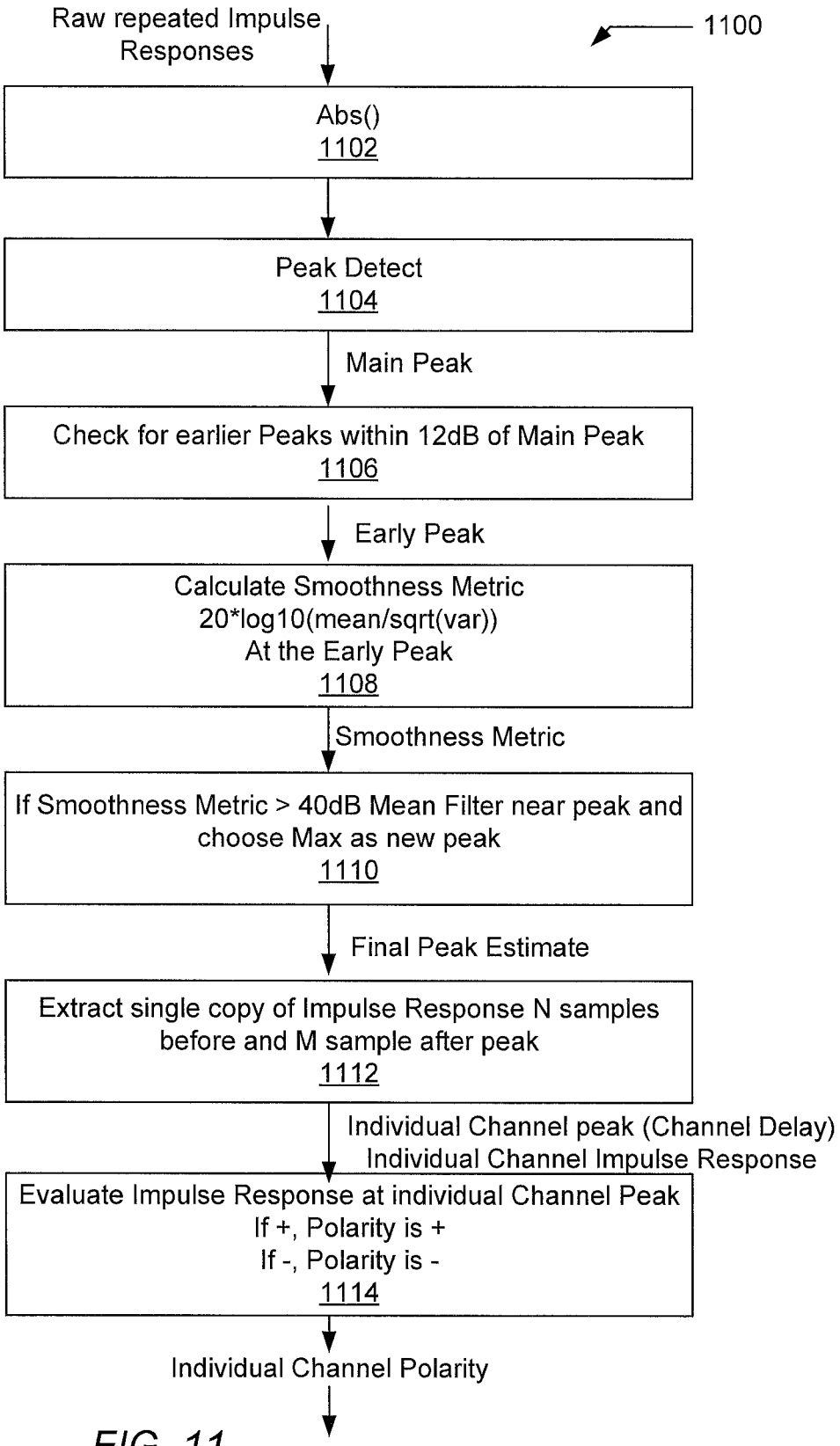
FIG. 11 is a flow diagram of the delay and polarity estimation modules of FIG. 3, for each channel in response to the test sequence of FIG. 2.
Figure 12:
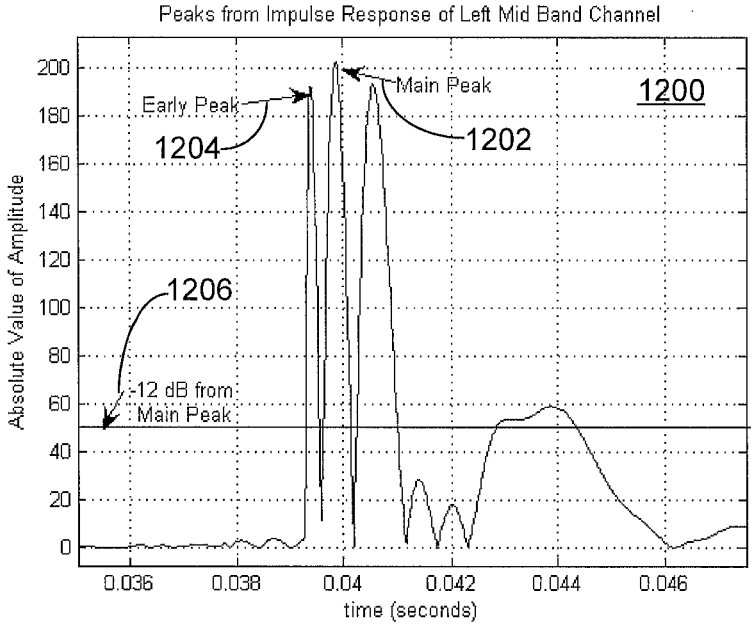
FIG. 12 is the absolute value of a zoomed-in version of the impulse responses calculated via cross-correlation of FIG. 9.

Turning to FIG. 11, a flow diagram 1100 of the delay and polarity estimation for each channel in response to the test sequence 200 of FIG. 2 is shown. The absolute value sequence of the raw repeated impulse response, as calculated after cross correlation 304 in FIG. 3 via cross-correlation, may be computed in step 1102. A version of the resulting sequence, zoomed in around its peaks, is shown in 1200 FIG. 12. In step 1104, the maximum peak, labeled 'Main Peak' 1202 may be determined. In step 1106, the earliest peak, labeled 'Early Peak' 1204 that falls within 12 dB of the 'Main Peak' 1202, but before the original peak in time is chosen. The line 1206 labeled '−12 dB from Main Peak' limits the search region for this early peak. Utilizing the 'Early Peak' 1204 ensures that the first perceived peak is utilized.

Figure 13:
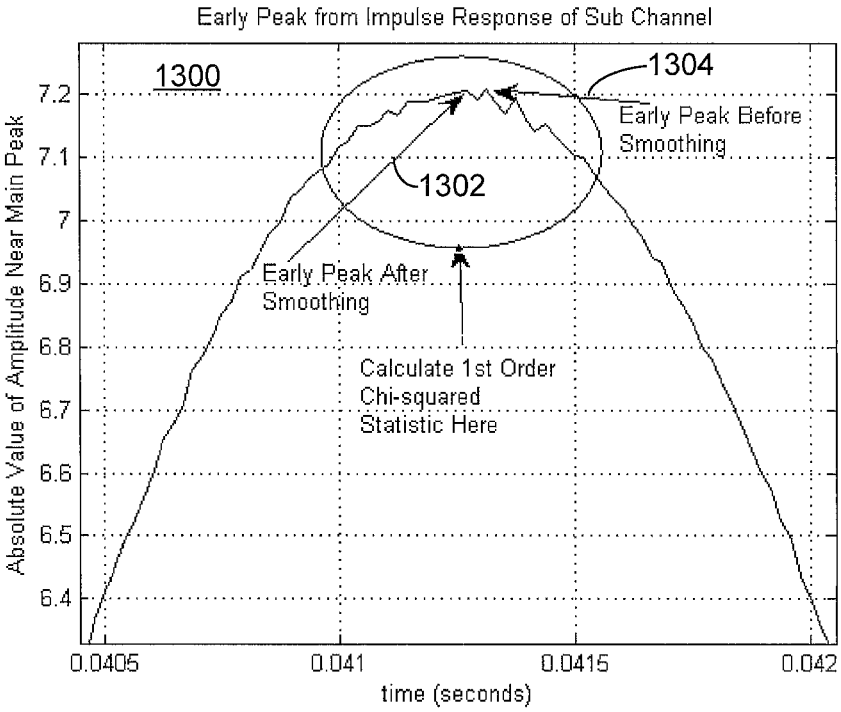
FIG. 13 is a graph of an early peak after smoothing from the impulse response of FIG. 12 of a subwoofer channel.

For low frequency channels, the added noise of the channel or the calculation may cause misidentification of the signal peak by several samples. In FIG. 13, a graph 1300 of an early peak after smoothing 1302 from the impulse response of FIG. 12 of a low-frequency (subwoofer) channel is shown. The early peak before smoothing 1304 is not located at the center of the time window. This may cause misalignment of low frequency channels, resulting in frequency nulling. To overcome this obstacle, a smoothness metric is calculated 1108, FIG. 11 as 20*log 10 (mean/sqrt(variance)), centered at the early peak estimate. If the smoothness metric is less than 40 dB, then the peak is considered to not be smooth. In this case, a peak may be easily identified without further smoothing. Midrange, tweeters, and full range channels fall into this category. If the smoothness metric is more than 40 dB 1110 FIG. 11, then the signal is already smooth, but could still contain noisy artifacts from the calculation or channel. Low bass/subwoofer channels may fall into this category. By mean filtering around this point, a better estimate of the center of peak is chosen. See 'early peak after smoothing' 1302, FIG. 13.

Figure 14:
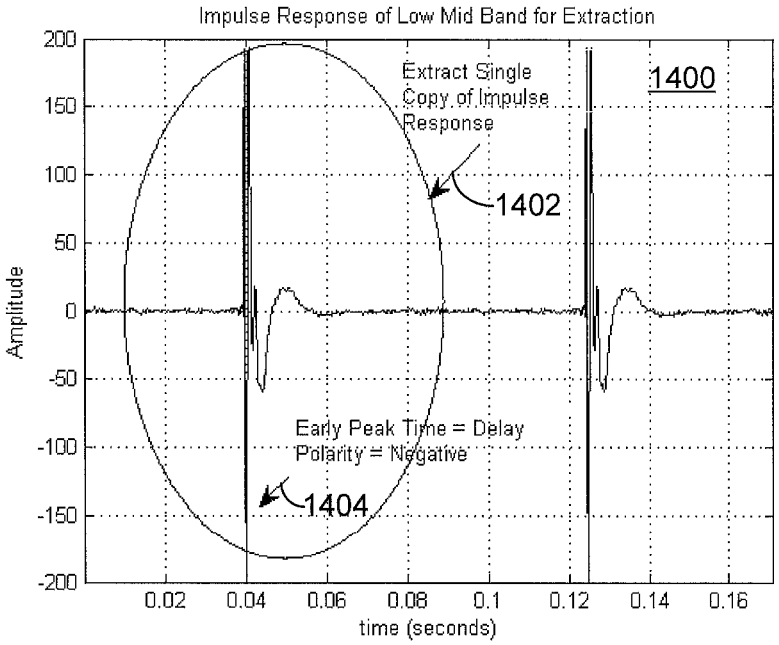
FIG. 14 is a graph of the impulse response extracted after the early peak is identified in FIG. 13 in order to measure the relative delay.

Once the early peak is identified for each channel, an impulse response is extracted 1112, FIG. 11, taking "N" samples before the early peak and "M" samples after the early peak. The impulse response is extracted after the early peak. The early peak (or main peak if no early peak is present) is identified independent of smoothing. The early peak is then checked for smoothness. If it is not "smooth", then smoothing the peak is not used. If it is found to be smooth, then the smoothing is applied in order to choose the appropriate point. The early peak (or main peak if no early peak) is shown as being identified in FIG. 13. In FIG. 14, a graph 1400 is depicted of the impulse response extracted after the early peak is identified to measure the relative delay depicted. The relative delay 1404 may be measured by extracting the time axis of the early peak 1402 as depicted in FIG. 14. The polarity may be obtained by extracting the sign of the early peak's magnitude 1114, FIG. 11. For a positive peak, the polarity is positive. For a negative peak, the polarity is negative.

The methods described with respect to FIGS. 1-5 and 11 may include additional steps or modules that are commonly performed during signal processing, such as moving data within memory and generating timing signals. The steps of the depicted diagrams of FIGS. 5 and 11 may also be performed with more steps or functions or in parallel.

It will be understood, and is appreciated by persons skilled in the art, that one or more processes, sub-processes, or process steps or modules described in connection with FIGS. 1-5 and 11 may be performed by hardware and/or software. If the process is performed by software, the software may reside in software memory (not shown) in a suitable electronic processing component or system such as, one or more of the functional components or modules schematically depicted or identified in FIGS. 1-5 and 11. The software in software memory may include an ordered listing of executable instructions for implementing logical functions (that is, "logic" that may be implemented either in digital form such as digital circuitry or source code), and may selectively be embodied in any computer readable media for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any tangible non transitory means that may contain, store or communicate the program for use by or in connection with the instruction execution system, apparatus, or device. The computer readable medium may selectively be, for example, but is not limited to, an electronic, magnetic, optical, electromagnetic, infrared, or semiconductor system, apparatus or device. More specific examples, but nonetheless a non-exhaustive list, of computer-readable media would include the following: a portable computer diskette (magnetic), a RAM (electronic), a read-only memory "ROM" (electronic), an erasable programmable read-only memory (EPROM or Flash memory) (electronic) and a portable compact disc read-only memory "CDROM" (optical). Note that the computer-readable medium may even be paper or another suitable medium upon which the program is printed and captured from and then compiled, interpreted or otherwise processed in a suitable manner if necessary, and then stored in a computer memory.

The foregoing description of implementations has been presented for purposes of illustration and description. It is not exhaustive and does not limit the claimed inventions to the precise form disclosed. Modifications and variations are possible in light of the above description or may be acquired from practicing examples of the invention. The claims and their equivalents define the scope of the invention.

What is claimed is:

1. An audio device connected to an existing sound system comprising:

at least a first audio input and a second audio input configured to receive at least a first audio signal and a second audio signal, each of the first audio input and the second audio input associated with respective channels;

a capture mechanism that captures at least first output data associated with the first audio signal and second output data associated with the second audio signal, the first output data and second output data captured from the existing sound system;

a digital signal processor having a parameter estimation unit and a memory, the parameter estimation unit configured to process the first output data and the second output data to obtain a plurality of parameters that are stored in the memory, the parameter estimation unit comprising a sample rate estimation module estimating a sampling rate of the first output data and the second output data, a cross correlation module configured to generate impulse response sequences of the existing sound system, a delay estimation module configured to estimate delays between the respective channels, a polarity module configured to determine polarities in the respective channels, wherein the plurality of parameters are applied by the digital signal processor to subsequent first audio signals and second audio signals.

2. The audio device of claim 1, wherein the first audio signal and the second audio signal are filtered with a pink filter.

3. The audio device of claim 1, wherein the first audio signal is generated from the memory.

4. The audio device of claim 1, wherein the plurality of parameters include delays, polarities and sample rate corrected impulse responses associated with the first audio input and second audio input.

5. The audio device of claim 1, wherein the capture mechanism automatically detects the beginning of the first audio signal and the second audio signal.

6. The audio device of claim 5, wherein the capture mechanism automatically detects the beginning of the first audio signal and the second audio signal by comparing the energy associated with the first audio signal and the second audio signal with a noise threshold.

7. The audio device of claim 1, wherein the capture mechanism stores in the memory more than two predetermined periods of first output data and second output data.

8. The audio device of claim 7, wherein at least one of the two predetermined periods is longer than a maximum expected delay difference between any of the respective channels.

9. The audio device of claim 1, wherein the parameter estimation unit processes the first output data and the second output data at predetermined intervals.

10. A method for determining parameters of an existing sound system comprising:

generating at least a first audio signal and a second audio signal for receipt by at least a first audio input and a second audio input of the existing sound system with each of the at least first audio input and second audio input associated with respective channels;

capturing with an electronic capture mechanism at least first output data associated with the first audio signal and second output data associated with the second audio signal, the first output data and second output data captured from the existing sound system;

processing, with a parameter estimation unit located in a digital signal processor, the first output data and the second output data to obtain a plurality of parameters;

the processing comprising the steps of:

estimating a sampling rate of the first output data and second output data, generating impulse response sequences of the existing sound system, estimating delays between the respective channels, determining polarities in the respective channels, and storing in a memory the plurality of parameters, wherein the plurality of parameters are applied by the digital signal processor to subsequent first audio signals and second audio signals.

11. The method of claim 10, wherein generating further includes generating the first audio signal from the memory.

12. The method of claim 10, wherein the processing with the parameter estimation unit includes determining delays, polarities and sample rate corrected impulse associated with the existing audio device.

13. The method of claim 10, wherein capturing with the capture mechanism further includes, detecting automatically the beginning of the first audio signal and the second audio signal.

14. The method of claim 13, wherein detecting further includes comparing the energy associated with the first audio signal and the second audio signal with a noise threshold.

15. The method of claim 10, wherein capturing with the capture mechanism further includes storing in the memory more than two predetermined periods of first output data and second output data.

16. The method of claim 15, wherein the two predetermined periods are longer than a maximum expected delay difference between any of the respective channels.

17. The method of claim 10, wherein processing with the estimation module of the first output data and the second output data occurs at predetermined intervals.

18. A non-transitory computer readable media that contains a plurality of machine readable instructions that when executed result in a method for determining parameters of an existing sound system comprised of instructions for the method steps of:

generating at least a first audio signal and a second audio signal for receipt by at least a first audio input and a second audio input of the existing sound system with each of the audio inputs associated with a channel;

capturing, with an electronic capture mechanism, at least first output data associated with the first audio signal and second output data associated with the second audio signal, the first output data and second output data captured from the existing sound system;

processing with parameter estimation unit located in a digital signal processor the first output data and the second output data to obtain a plurality of parameters;

the processing comprising the steps of:

estimating a sampling rate of the first output data and the second output data, generating impulse response sequences of the existing sound system, estimating delays between the respective channels, determining polarities in the respective channels, and storing in a memory the plurality of parameters, wherein the plurality of parameters are applied by the digital signal processor to subsequent first audio signals and second audio signals.

19. The non-transitory computer readable media with instructions of claim 18, includes instructions for the step of generating the first audio signal from the memory.

20. The non-transitory computer readable media with instructions of claim 18, wherein the instructions for the step of the processing with the parameter estimation unit includes instructions for determining delays, polarities and sample rate corrected impulses associated with the existing audio device.

* * * * *

UNITED STATES PATENT AND TRADEMARK OFFICE

CERTIFICATE OF CORRECTION

PATENT NO. : 9,241,230 B2
APPLICATION NO. : 13/909458
DATED : January 19, 2016
INVENTOR(S) : Ulrich Horbach et al.

It is certified that error appears in the above-identified patent and that said Letters Patent is hereby corrected as shown below:

IN THE SPECIFICATION

In column 1, from line 7-17, under Related Applications section

Delete "This application is a continuation in part of and claims the priority of U.S. patent application Ser. No. 12/293,062, filed on Mar. 5, 2009, titled WIDE-BAND EQUALIZATION SYSTEM, U.S. Publication Number 2009/0316930, which is a §371 application of PCT Patent Application Serial Number PCT/US2007/064006, titled WIDE BAND EQUALIZATION IN SYSTEM, filed Mar. 14, 2007, claiming priority to U.S. Provisional Patent Application Ser. No. 60/782,369, titled WIDE BAND EQUALIZATION IN SMALL SPACES, filed Mar. 14, 2006, all the application of which are incorporated in their entirety by reference in this application."

Add -- This application is a continuation of Application No. 12/858,791, filed August 18, 2010, which is a continuation in part of Application No. 12/293,062, filed March 5, 2009, which is the National Stage of International Application No. PCT/US2007/064006, filed March 14, 2007, which claims the benefit of Provisional Application No. 60/782,369, filed March 14, 2006, all the applications of which are incorporated in their entirety by reference in this application. --

Signed and Sealed this
Nineteenth Day of April, 2016

Michelle K. Lee

Michelle K. Lee
*Director of the United States Patent and Trademark Office*